United States Patent [19]

Hattori

[11] 4,269,028

[45] May 26, 1981

[54] SECONDARY AIR SUPPLY SYSTEM FOR THE EXHAUST SYSTEM OF AN INTERNAL COMBUSTION ENGINE

[75] Inventor: Kyo Hattori, Susono, Japan

[73] Assignee: Toyota Jidosha Kogyo Kabushiki Kaisha, Japan

[21] Appl. No.: 893,402

[22] Filed: Apr. 4, 1978

[30] Foreign Application Priority Data

Dec. 29, 1977 [JP] Japan ..... 52-159306

[51] Int. Cl.[3] ..... F01N 3/10; F16K 31/42

[52] U.S. Cl. ..... 60/276; 60/289; 251/31; 251/61; 251/61.4

[58] Field of Search ..... 60/276, 290, 289; 251/31, 61.4, 61 R

[56] References Cited

U.S. PATENT DOCUMENTS

| | | | |
|---|---|---|---|
| 3,255,772 | 6/1966 | Williams | 251/31 |
| 4,087,964 | 5/1978 | Miyagi | 60/293 |
| 4,100,735 | 7/1978 | Miyagi | 60/290 |
| 4,112,678 | 9/1978 | Miyagi | 60/289 |
| 4,141,214 | 2/1979 | Mitsuda | 60/276 |
| 4,147,030 | 4/1979 | Katahira | 60/276 |
| 4,159,626 | 7/1979 | Shibata | 60/290 |
| 4,162,612 | 7/1979 | Mitsuda | 60/290 |

FOREIGN PATENT DOCUMENTS

| | | | |
|---|---|---|---|
| 200455 | 2/1955 | Australia | 251/61 R |
| 1272667 | 7/1968 | Fed. Rep. of Germany | 251/61.4 |

*Primary Examiner*—Douglas Hart

*Attorney, Agent, or Firm*—Stevens, Davis, Miller & Mosher

[57] ABSTRACT

A secondary air supply system for the exhaust system of an internal combustion engine having a catalytic converter with a three-way catalyst, having an air control valve which selectively supplies a part of compressed air to the exhaust system while relieving the rest of the air to the atmosphere, wherein the air control valve has a valve element balanced by oppositely acting springs to a neutral position where it supplies a predetermined amount of secondary air necessary to provide stoichiometric exhaust gases at a standard flow of exhaust gases and is shifted to opposite sides of the neutral position in accordance with oscillation of feedback control of the air/fuel ratio of exhaust gases.

5 Claims, 3 Drawing Figures

SECONDARY AIR SUPPLY SYSTEM FOR THE EXHAUST SYSTEM OF AN INTERNAL COMBUSTION ENGINE

BACKGROUND OF THE INVENTION

The present invention relates to a secondary air supply system for the exhaust system of an internal combustion engine, and, more particularly, to an air control valve incorporated in the secondary air supply system.

In an exhaust gas purifying system which incorporates a three-way catalyst for simultaneously removing HC, CO, and NOx contained in the exhaust gases of an internal combustion engine, the air/fuel ratio of the exhaust gases must be controlled to be within a relatively narrow range of the stoichiometric air/fuel ratio in order to obtain effective performance of the three-way catalyst. Therefore, in the exhaust gas purifying system incorporating a three-way catalyst, the air/fuel ratio of engine intake mixture is set on the smaller or rich side of the stoichiometric air/fuel ratio, and the exhaust gases generated from such a mixture are supplied with secondary air while the air/fuel ratio is monitored by an oxygen detector so that the air/fuel ratio of the exhaust gases introduced into the three-way catalyst is maintained within a relatively narrow range (the window range) around the stoichiometric air/fuel ratio which is required to obtain effective performance of the three-way catalyst.

A secondary air supply system which supplies secondary air to the exhaust system of an engine for the aforementioned purpose generally comprises a source of compressed air such as an air pump driven by the engine, an air control valve which supplies a part of the air delivered from said source to the exhaust system of the engine while relieving the rest of the air, an oxygen detector for detecting residual oxygen contained in the exhaust gases flowing through the exhaust system, a source of actuating fluid pressure (for which the intake manifold generally serves to supply intake manifold vacuum as the actuating fluid pressure), a change-over valve for said actuating fluid pressure, and a controller which changes over said change-over valve in accordance with the output of said oxygen detector, said air control valve supplying the air delivered from said source of compressed air to the exhaust system as secondary air when said oxygen detector detects no residual oxygen while it stops supplying secondary air to the exhaust system while relieving the air supplied from said source of compressed air to the atmosphere, or, generally, into the air cleaner of the engine, when the oxygen detector detects residual oxygen. The air control valve incorporated in the conventional secondary air supply system generally comprises an inlet port for receiving air from a source of compressed air such as an air pump driven by the engine, an outlet port for supplying a part of the air received to the exhaust system, and a relief port for relieving the rest of the air received. A first passage connects said inlet port and said outlet port, a second passage connects said inlet port and said relief port, a valve element which reciprocally controls the openings of said first and second passages, first and second diaphragm chambers selectively supplied with either intake manifold vacuum or atmospheric pressure by way of said change-over valve, and at least one diaphragm which defines said individual diaphragm chambers and is connected with said valve element. Thus the diaphragm is adapted so as to shift said valve element in the direction to open said first passage and to close said second passage when said first diaphragm chamber is supplied with intake manifold vacuum while said second diaphragm chamber is opened to the atmosphere, and so as to shift said valve element in the direction to open said second passage and to close said first passage when said second diaphragm chamber is supplied with intake manifold vacuum while said first diaphragm chamber is opened to the atmosphere.

The secondary air supply system for the exhaust system of an internal combustion engine which incorporates an air control valve of the aforementioned structure together with an oxygen detector, a vacuum change-over valve, and a controller which changes over said vacuum change-over valve in accordance with the output of said oxygen detector is a feedback control system which supplies additional air as the secondary air to the basic exhaust gases having an air/fuel ratio which is somewhat lower than the lower limit of the window range. Thus the air/fuel ratio of exhaust gases is controlled in a manner such that it changes in the shape of triangular pulse waves going up and down on either side of the center of the window range. In this case, if the flow resistance of the passages for introducing intake manifold vacuum or atmospheric pressure to said first and second diaphragm chambers is reduced, i.e. the throttling ratio of a throttling element normally provided in such a passage is reduced, in order to increase the response speed of the feedback control system, the amplitude of the triangular pulse waves becomes greater, and the phase region in which the air/fuel ratio of exhaust gases overshoots or undershoots the window region increases, thereby reducing the effectiveness of the three-way catalyst. If, on the other hand, in view of the abovementioned problem, the throttling ratio of the fluid passages for said first and second diaphragm chambers is increased in order to reduce the amplitude of the triangular pulse-like changes of the air/fuel ratio of exhaust gases so that it is contained in the window range, the response speed of the feedback control system lowers, and the control of the secondary air supply cannot follow swift changes of intake air flow or fuel-air mixture of the engine, also resulting in poor effectiveness of the three-way catalyst exhaust purifying system as a whole.

Particularly, in a secondary air supply system for the exhaust system of an internal combustion engine of the aforementioned conventional structure, there is a problem that when the intake air flow or air/fuel ratio of the engine abruptly changes, the controlled air/fuel ratio of exhaust gases greatly changes because the operational inertia and delay in response of the system are relatively large.

SUMMARY OF THE INVENTION

It is therefore the object of the present invention to deal with the aforementioned problems with regard to the conventional secondary air supply system for the exhaust system of an internal combustion engine, particularly the problems with regard to the conventional air control valve, and to provide an improved secondary air supply system for the exhaust system of an internal combustion engine, which is able to maintain the air/fuel ratio of exhaust gases within a narrow window range centered at the stoichiometric air/fuel ratio with correct and quick response.

Another object of the present invention is to provide an improved secondary air supply system for the exhaust system of an internal combustion engine, which is able to follow the changes of intake air flow or air/fuel ratio of the engine continuously and efficiently and is able to maintain the air/fuel ratio of exhaust gases within the window range even when the intake air flow or the air/fuel ratio of the engine is abruptly changed.

BRIEF DESCRIPTION OF THE DRAWINGS

The present invention will become more fully understood from the detailed description given herein below and the accompanying drawings, which are given by way of illustration only, and thus are not limitative of the present invention, and wherein.

DESCRIPTION OF THE PREFERRED EMBODIMENT

Figure 1:
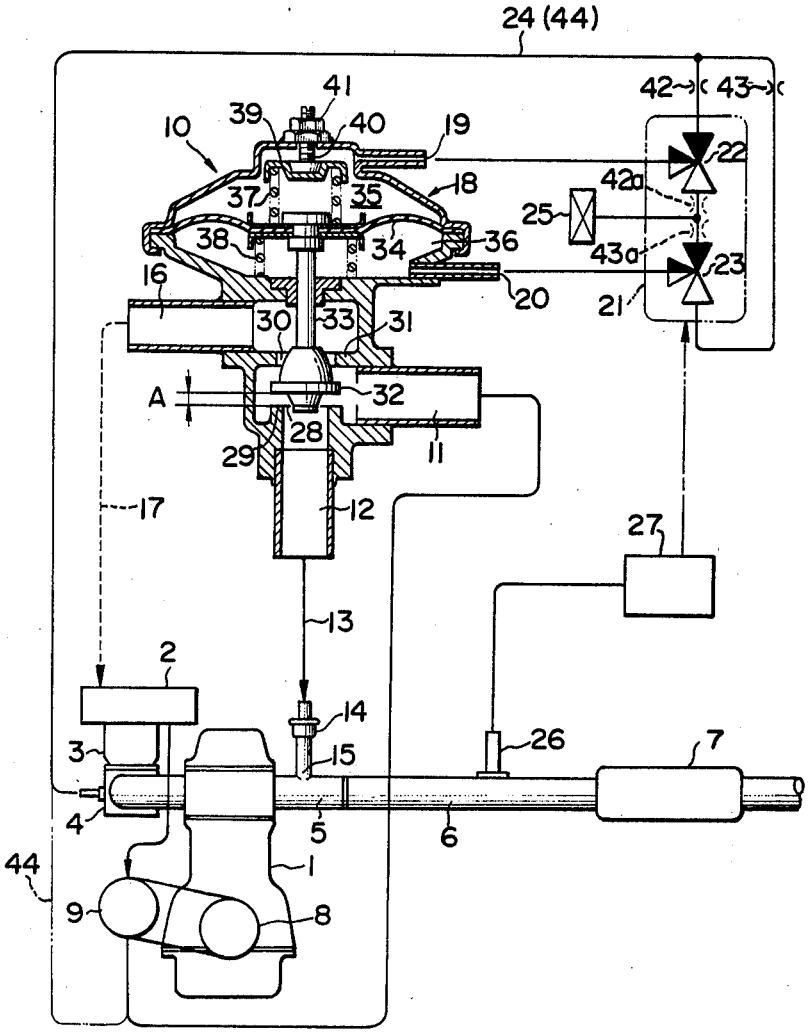
FIG. 1 is a diagrammatical view showing an embodiment of the secondary air supply system for the exhaust system of an internal combustion engine constructed in accordance with the present invention.

Referring to FIG. 1, 1 designates an internal combustion engine which takes in air through an air cleaner 2, a carburetor 3 and an intake manifold 4 and discharges exhaust gases through an exhaust manifold 5 and an exhaust pipe 6 which incorporates at a middle portion thereof a catalytic converter 7 containing a three-way catalyst, whereby the engine generates a rotary power in a crankshaft 8. 9 designates an air pump which is driven by the crankshaft 8 and serves as a source of compressed air to be supplied as secondary air. The air delivered from the air pump 9 is conducted to an inlet port 11 of an air control valve 10, wherein a part of the air is conducted to an outlet port 12 and is further conducted through a passage 13 and a secondary air manifold 14 to be supplied to the exhaust system of the engine through a secondary air supply port 15, whereas the rest of the air received by the air control valve 10 is conducted to a relief port 16 and is further conducted through a passage 17 to be relieved to the atmosphere, or particularly in the shown embodiment to be relieved into the air cleaner 2. The air control valve 10 has a diaphragm means 18 having two actuating fluid supply ports 19 and 20 which are adapted to be selectively supplied with either intake manifold vacuum taken out from the intake manifold 4 and conducted through a passage 24 and a change-over valve 21, which, in the shown embodiment, is a composite of two change-over valves 22 and 23, or atmospheric pressure taken in through an air filter 25 and through the change-over valve 21.

The change-over valve 21 is changed over by a controller 27 which operates in accordance with the output of an oxygen detector 26 which detects residual oxygen contained in the exhaust gases flowing through the exhaust system of the engine.

The air control valve 10 has a first valve seat 29 which defines a first passage 28 between the inlet port 11 and the outlet port 12, a second valve seat 31 which defines a second passage 30 between the inlet port 11 and the relief port 16, and a valve element 32 which reciprocally controls the openings of the first and the second passages 28 and 30 in cooperation with the first and the second valve seats 29 and 31. The valve element 32 is connected with a diaphragm 34 of the diaphragm means 18 by way of a valve stem 33. Above the diaphragm 34 as seen in the figure is defined a first diaphragm chamber 35 communicating to the port 19, while below the diaphragm is defined a second diaphragm chamber 36 communicating to the port 20.

In the diaphragm chambers 35 and 36 are provided compression coil springs 37 and 38 which individually contact with the opposite side of the diaphragm 34 at one end thereof so as to exert mutually opposing spring forces on the diaphragm. The other end of the spring 37 is supported by a seat element 39 which in turn is supported by an adjusting screw 40. The balance point of these two mutually opposing spring forces may be adjusted by loosening a locknut 41 and turning the adjusting screw 40. The mutually opposing spring forces of the compression coil springs 37 and 38 are so balanced that, when the fluid pressures existing in the diaphragm chambers 35 and 36 are equal to each other, the diaphragm 34 is held at a neutral position such as shown in FIG. 1, whereby it holds the valve element 32 by way of the valve stem 33 at its neutral position, raised from the valve seat 29 by distance A so as to provide a predetermined ratio between the openings of said first and second passages 28 and 30. This neutral position of the valve element is such that when a part of the air supplied to the inlet port 11 from the air pump 9 is conducted through the first passage 28 and the outlet port 12 toward the exhaust system of the engine with the rest of the air being relieved through the second passage 30 and the relief port 16, the air/fuel ratio of exhaust gases is adjusted substantially to the stoichiometric value.

Figure 2:
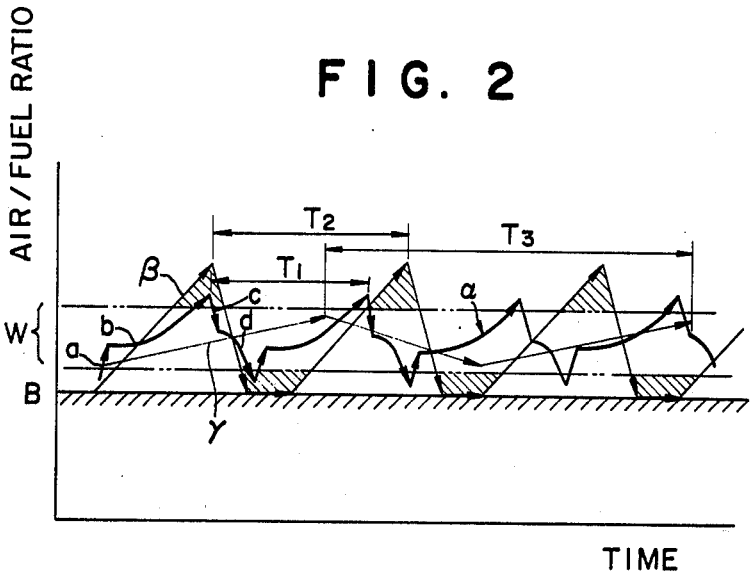
FIG. 2 is a graph showing the secondary air flow performance obtained by the secondary air supply system of the present invention, wherein the secondary air flow performance of a secondary air supply system employing the conventional ON/OFF type air control valve is also shown for the purpose of comparison.

The operation of the secondary air supply system shown in FIG. 1 will be explained with reference to FIG. 2. In FIG. 2 the value B of air/fuel ratio is the basic air/fuel ratio of the exhaust gases discharged from the combustion chamber of the engine to the exhaust manifold 5, and is equivalent to the air/fuel ratio of the intake mixture generated by the carburetor 3. W shows a window region centered at the stoichiometric air/fuel ratio and having a range in which the air/fuel ratio of exhaust gases is to be maintained to obtain effective operation of the three-way catalyst.

Now let us assume that the change-over valve 22 is so changed over that the port 19 of the diaphragm means 18 is open to the atmosphere through the air filter 25, whereas the change-over valve 23 is so changed over that the port 20 is connected with the intake manifold 4 through the passage 24. Then, since the fluid pressure in the diaphragm chamber 36 is lower than that in the diaphragm chamber 35, the valve element 32 is shifted downward in the figure from the neutral position so that the passage 28 connecting the inlet port 11 and the outlet port 12 is throttled to a greater degree. In this condition the flow of secondary air supplied to the exhaust system is reduced, and therefore the air/fuel ratio of the exhaust gases lowers below the stoichiometric value, with the result that the residual oxygen contained in the exhaust gases flowing through the exhaust system disappears. If the residual oxygen disappears, this is monitored by the oxygen detector 26 and the controller 27 is operated so as to change over the change-over valves 22 and 23 in the opposite direction, so that the port 20 is now opened to the atmosphere through the air filter 25, whereas the port 19 is connected with the vacuum passage 24. By this change-over of the change-over valves, the pressure in the diaphragm chamber 36 immediately increases up to atmospheric pressure, while on the other hand the supply of manifold vacuum to the diaphragm chamber 35 is delayed by a throttling element 42 provided at a middle portion of the vacuum passage. Therefore, immediately after the changing-over of the change-over valves 22 and 23, for a moment the diaphragm chambers 35 and 36 are both supplied with atmospheric pressure at substantially the same pressure. At this moment the diaphragm 34 and the valve element 32 connected therewith are rapidly shifted upward in the figure by the spring force of the compression coil spring 38 and are brought to their neutral positions as shown in FIG. 1 where the compression coil springs 37 and 38 balance with each other. The change of air/fuel ratio due to this operation of the air control valve is shown by path a in FIG. 2. After the diaphragm 34 and the valve element 32 have been brought to their neutral positions as shown in FIG. 1, due to gradual drawing of the air contained in the diaphragm chamber 35 through the vacuum passage 24 including the throttling element 42, the diaphragm 34 is gradually shifted upward in the figure. In this case, immediately after the path a the air in the diaphragm chamber 35 is somewhat compressed by the balancing force of the coil springs 37 and 38, and therefore, when the air in the diaphragm chamber 35 is gradually drawn out, the pressure in the diaphragm chamber 35 is substantially the same as that in the diaphragm chamber 36 for a while, and after the lapse of a certain time the pressure in the diaphragm chamber 35 begins to lower substantially. By this operation of the air control valve, the air/fuel ratio of exhaust gases changes as shown by path b in FIG. 2. As it approaches the end of the path b, the air/fuel ratio of exhaust gases increases beyond the stoichiometric value, and residual oxygen now appears in the exhaust gases. This is monitored by the oxygen sensor 26, and the controller 27 is operated so as to change over the change-over valves 22 and 23 in the opposite direction. By this changing over of the change-over valves, the port 19 is immediately opened to the atmosphere through the change-over valve 22 and the air filter 25, whereby the pressure in the diaphragm chamber 35 is rapidly brought back to atmospheric pressure. On the other hand, although the port 20 is also immediately connected to the vacuum passage 24 through the change-over valve 23, drawing out of air from the diaphragm chamber 26 is delayed by the throttling action of a throttling element 43 provided at a middle portion of the vacuum passage. Therefore, immediately after the change-over of the change-over valves 22 and 23, for a moment the diaphragm chambers 35 and 36 are both supplied with atmospheric pressure at substantially the same pressure. At this moment the diaphragm 34 and the valve element 32 connected therewith are rapidly driven downward in the figure by the compression coil spring 37 and are brought to their neutral positions as shown in FIG. 1 where the compression coil springs 37 and 38 balance with each other. By this operation of the air control valve, the air/fuel ratio of exhaust gases changes as shown by path c in FIG. 2. Thereafter, as the air in the diaphragm chamber 36 is gradually drawn out by manifold vacuum, the diaphragm 34 is shifted downward in the figure. Also in this case, since the air in the diaphragm chamber 36 is somewhat compressed at the end of the path c due to the balancing force of the coil springs 37 and 38, in the initial stage of drawing out of air from the diaphragm chamber 36 the pressure in the diaphragm chamber 36 remains substantially equal to that in the diaphragm chamber 35, and thereafter the pressure in the diaphragm chamber 36 gradually lowers. By this operation of the air control valve, the air/fuel ratio of exhaust gases changes as shown by path d in FIG. 2. In this connection, the difference between the paths b and d is due to the difference in the throttling ratio between the throttling elements 42 and 43. Thereafter the paths a, b, c, and d are repeated, and the air/fuel ratio of exhaust gases varies as shown by a stepped triangular wave substantially within the window region W with a high concentration around the central stoichiometric value. It is to be noted that instead of the throttling elements 42 and 43 provided at middle portions of the vacuum passages as shown in FIG. 1, throttling elements **42*a* and 42*b* may be provided at middle portions of relief passages. It will be apparent that such a substitution provides the same operation, except that in this case the pressures in the diaphragm chambers 35 and 36** in the paths a and d are both intake manifold vacuum and balance with each other.

In FIG. 2, for the purpose of comparison, the path of air/fuel ratio of exhaust gases obtained by a secondary air supply system depending upon a feedback control employing a conventional simple ON/OFF type air control valve is shown as two triangular pulse waves $\beta$ and $\gamma$. The triangular pulse wave $\beta$ shows a path in such a condition that the throttling ratio of throttling elements provided in the passages for selectively supplying manifold vacuum or atmospheric pressure to the diaphragm chambers of the air control valve is relatively moderate so that the response speed of the feedback control is relatively high. On the other hand, the triangular pulse wave $\gamma$ shows a path in such a condition that the throttling ratio of the throttling elements is relatively great so that the amplitude of oscillation of air/fuel ratio is reduced at the sacrifice of the response speed of feedback control. In the case of the triangular pulse wave $\beta$, it is unavoidable that the air/fuel ratio of exhaust gases substantially overshoots and undershoots up and down the window region W as shown by hatched regions in the figure. In this case, therefore, the effectiveness of the three-way catalyst is correspondingly reduced. Nevertheless, the response speed in this case is still relatively low as the comparison of period T2 of the triangular pulse wave $\beta$ to period T1 of the stepped triangular pulse wave including the skipping paths a and c toward the stoichiometric air/fuel ratio obtained by the system of the present invention shows. On the other hand, if the throttling ratio of the throttling element is increased in the conventional system so as to reduce the amplitude of oscillation of air/fuel ratio, as in the case of the triangular pulse wave $\gamma$, the period of the pulse wave becomes very long, as T3, whereby the response speed of the feedback control substantially lowers, so that the capacity of the secondary air supply system to follow changes of intake air flow and air/fuel ratio of the engine is substantially damaged.

Figure 3:
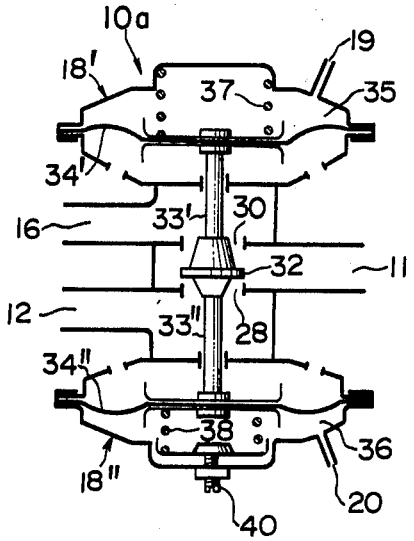
FIG. 3 is a diagrammatical view showing another embodiment of the air control valve incorporated in the secondary air supply system shown in FIG. 1, wherein the air control valve is shown together with associated change-over valves for changing over the supply of actuating fluid pressure.

FIG. 3 is a diagrammatical sectional view showing another embodiment of the air control valve such as 10 in FIG. 1. In FIG. 3 the portions corresponding to those shown in FIG. 1 are designated by the same reference numerals, whereas the portions which correspond to those shown in FIG. 1 but have been separated into two parts are designated by the corresponding numerals modified by ′ and ″. In the embodiment shown in FIG. 3, the diaphragm means 18 in the embodiment of FIG. 1 providing diaphragm chambers 35 and 36 is separated into a diaphragm means 18′ providing the diaphragm chamber 35 and a diaphragm means 18″ providing the diaphragm chamber 36, and, in accordance with this, the diaphragm is also separated into a diaphragm 34′ which belongs to the diaphragm means 18′ and defines the diaphragm chamber 35 and a diaphragm 34″ which belongs to the diaphragm means 18″ and defines the diaphragm chamber 36. The valve element 32 is connected with the diaphragm 34′ by way of a valve stem 33′ and is also connected with the diaphragm 34″ by way of a valve stem 33″, so that the diaphragms 34′ and 34″ are mutually connected while the valve element 32 is driven by the co-operation of these two diaphragms. The compression coil spring 37 engages the diaphragm 34′, while the compression coil spring 38 engages the diaphragm 34″. However, due to the mutual engagement of the diaphragms 34′ and 34″ by the way of the valve element 32 and the valve stems 33′ and 33″, the valve element 32 is held at its neutral position by the balance of mutually opposing spring forces of the compression coil springs 37 and 38 in the same manner as in the embodiment shown in FIG. 1. In this embodiment, the neutral position is adjusted by turning the adjusting screw 40 which is provided on the side of the spring 38. It will be apparent that by substituting the air control valve **10*a* shown in FIG. 3 for the air control valve 10 incorporated in the secondary air supply system of FIG. 1** the same operation for the supply of secondary air as explained above is performed.

Although the diaphragm chambers 35 and 36 are selectively supplied with either manifold vacuum or atmospheric pressure in the above explanations, delivery air pressure of the air pump 9 may be used as the actuating fluid pressure instead of manifold vacuum so that the air pressure conducted through a passage 44 to the actuating fluid change-over valve 21 and atmospheric pressure are reciprocally supplied to the diaphragm chambers 35 and 36, although in this case the supply of the air pump delivery pressure and atmospheric pressure must be exchanged with each other for the same operation of secondary air supply when compared with the case of employing manifold vacuum as the actuating fluid pressure.

Although the invention has been shown and described with respect to some preferred embodiments thereof, it should be understood by those skilled in the art that various changes and omissions of the form and detail thereof may be made therein without departing from the scope of the invention.

I claim:

1. A secondary air supply system for the exhaust system of an internal combustion engine, comprising a source of compressed air, an air control valve which supplies a part of the air delivered from said source to the exhaust system of the engine while relieving the rest of the air, an oxygen detector for detecting residual oxygen contained in the exhaust gases flowing through the exhaust system, a source of actuating fluid pressure different from atmospheric pressure, a change-over valve for said actuating fluid pressure, a controller which changes over said change over valve in accordance with the output of said oxygen detector, said air control valve having an inlet port for receiving air from said source of compressed air, an outlet port for supplying a part of the air received to the exhaust system, a relief port for relieving the rest of the air received, a first passage which connects said inlet port and said outlet port, a second passage which connects said inlet port and ssaid relief port, a valve element which reciprocally controls the openings of said first and second passages, first and second diaphragm chambers selectively supplied with either said actuating fluid pressure or atmospheric pressure by way of said change-over valve, at least one diaphragm which defines said individual diaphragm chambers and is connected with said valve element, first and second springs which are separate from said diaphragm and which reciprocally operate to balance said valve element at a neutral position where a predetermined opening ratio of said first passage to said second passage is established, said change-over valve having a first change-over position wherein it connects said first diaphragm chamber to said source of actuating fluid pressure while it connects said second diaphragm chamber to the atmosphere and a second change-over position where it connects said second diaphragm chamber to said source of actuating fluid pressure while it connects said first diaphragm chamber to the atmosphere, and throttle means for throttling only either one of two flows of fluid, one of which is the flow of fluid which flows through said change-over valve between said source of actuating fluid pressure and said diaphragm chambers, and the other of which is the flow of fluid which flows through said change-over valve between the atmosphere and said diaphragm chambers, wherein said diaphragm or diaphragms are adapted so as to shift said valve element against the balancing force of said first and second springs in the direction to increase the opening of said first passage and to decrease the opening of said second passage when the fluid pressure in said first diaphragm chamber is lower than the fluid pressure in said second diaphragm chamber, and so as to shift said valve element against the balancing force of said first and second springs in the direction to increase the opening of said second passage and to decrease the opening of said first passage when the fluid pressure in said second diaphragm chamber is lower than the fluid pressure in said first diaphragm chamber, said spring and said throttle means cooperating each time said change-over valve is actuated, to rapidly return said valve element to said neutral position by said first and second springs and to maintain said element for a while at said neutral position due to the delay of fluid flow caused by said throttle means and thereafter to gradually shift said element in one of said two directions in accordance with the fluid pressure in said first and second diaphragm chambers.

2. The secondary air supply system of claim 1, wherein said air control valve has a diaphragm means including a diaphragm as the sole one of said diaphragm or diaphragms, said first and second diaphragm chambers defined at opposite sides of said diaphragm, a valve stem connecting said diaphragm and said valve element, and said first and second springs acting upon said diaphragm at opposite sides thereof.

3. The secondary air supply system of claim 2, wherein said first and second springs are both compression coil springs.

4. The secondary air supply system of claim 1, wherein said air control valve comprises first and second diaphragm means, said first diaphragm means including a first one of said diaphragms, said first diaphragm chamber defined at one side of said first diaphragm, a first valve stem connecting said first diaphragm and said valve element, and said first spring acting on said first diaphragm, said second diaphragm means including a second one of said diaphragms, said second diaphragm chamber defined at one side of said second diaphragm, a second valve stem connecting said second diaphragm and said valve element, and said second spring acting on said second diaphragm.

5. The secondary air supply system of claim 4, wherein said first and second springs are both compression coil springs.

* * * * *